US005251904A

United States Patent [19]

Cruz

[11] Patent Number: 5,251,904

[45] Date of Patent: Oct. 12, 1993

[54] BOARD GAME APPARATUS

[76] Inventor: Jose A. Cruz, 540 McKnight St., Reading, Pa. 19601

[21] Appl. No.: 933,763

[22] Filed: Aug. 24, 1992

[51] Int. Cl.[5] ..... A63F 3/00

[52] U.S. Cl. ..... 273/243; 273/238

[58] Field of Search ..... 273/237, 238, 243, 248, 273/249, 288

[56] References Cited

U.S. PATENT DOCUMENTS

| | | | |
|---|---|---|---|
| 2,746,756 | 5/1956 | Sitton, Jr. | 273/288 X |
| 3,733,074 | 5/1973 | Daley | 273/238 |
| 3,854,725 | 12/1974 | Cluck | 273/238 |
| 3,984,109 | 10/1976 | Wiles | 273/288 X |
| 4,324,405 | 4/1982 | Kruger, Jr. et al. | 273/238 |
| 4,557,485 | 12/1985 | Lardon | 273/249 X |
| 4,566,698 | 1/1986 | Sneden | 273/249 |
| 5,067,720 | 11/1991 | Bundy | 273/288 X |
| 5,121,928 | 6/1992 | Salerno-Sonneberg | 273/243 |

FOREIGN PATENT DOCUMENTS

| | | | |
|---|---|---|---|
| 1195760 | 11/1959 | France | 273/238 |
| 2544624 | 10/1984 | France | 273/243 |
| 2199253 | 7/1988 | United Kingdom | 273/243 |

*Primary Examiner*—William Stoll

*Attorney, Agent, or Firm*—Leon Gilden

[57] ABSTRACT

A board game includes a continuous path having a plurality of categories indicated by various spaces within the path, wherein each category is directed to a various procedure to include a pantomime, response to trivia question, perform a charade, or lose a turn. Limited time frames are available to effect completion of each category, wherein a card deck includes each category thereon for a performance by an individual or teams of individuals.

1 Claim, 4 Drawing Sheets

FIG 9
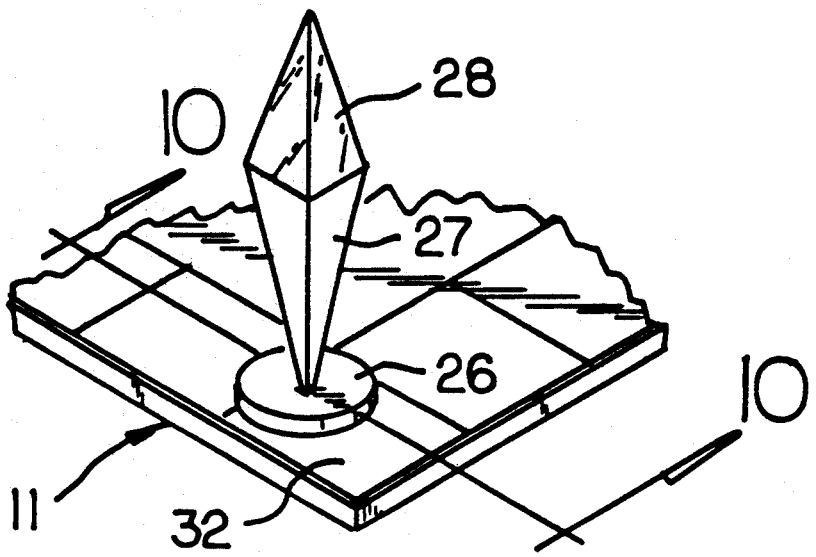
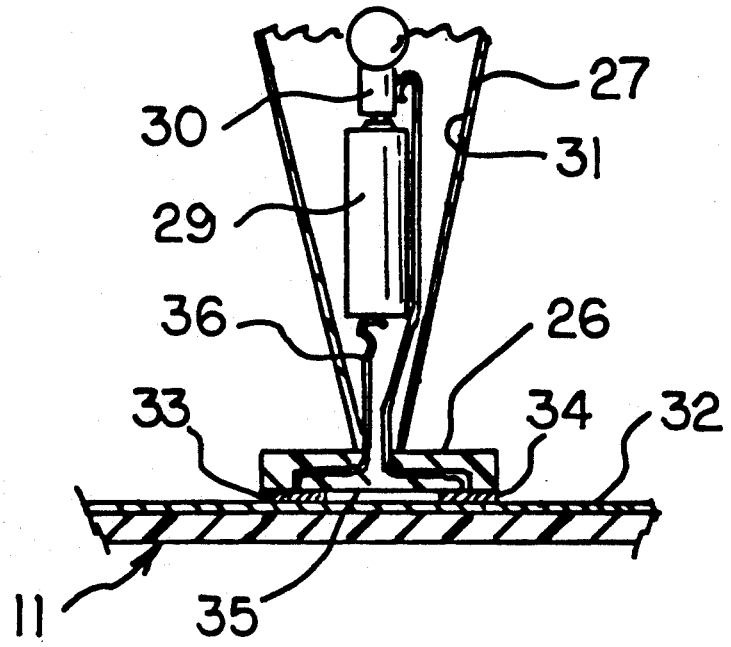
FIG 10

BOARD GAME APPARATUS

BACKGROUND OF THE INVENTION

1. Field of the Invention

The field of invention relates to board game apparatus, and more particularly pertains to a new and improved board game apparatus wherein the same is arranged to effect performance by individuals upon a player's landing upon preselected spaces of a game path.

2. Description of the Prior Art

Board games of various types have been utilized throughout the prior art for the entertainment and amusement of individuals. Such game boards are indicated and exemplified in the U.S. Pat. Nos. 4,966,371; 5,007,651; and 4,878,675.

The instant invention attempts to overcome deficiencies of the prior art by providing a board game structure utilizing performance and successful attainment of point totals developed by successful completion of various random categories encountered by tokens of the individual players and in this respect, the present invention substantially fulfills this need.

SUMMARY OF THE INVENTION

In view of the foregoing disadvantages inherent in the known types of board game apparatus now present in the prior art, the present invention provides a board game apparatus wherein the same is directed to the performance of various categories encountered by players in completion of the categories of the game. As such, the general purpose of the present invention, which will be described subsequently in greater detail, is to provide a new and improved board game apparatus which has all the advantages of the prior art board game apparatus and none of the disadvantages.

To attain this, the present invention provides a board game including a continuous path having a plurality of categories indicated by various spaces within the path, wherein each category is directed to a various procedure to include a pantomime, response to trivia question, perform a charade, or lose a turn. Limited time frames are available to effect completion of each category, wherein a card deck includes each category thereon for a performance by an individual or teams of individuals.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved board game apparatus which has all the advantages of the prior art board game apparatus and none of the disadvantages.

It is another object of the present invention to provide a new and improved board game apparatus which may be easily and efficiently manufactured and marketed.

It is a further object of the present invention to provide a new and improved board game apparatus which is of a durable and reliable construction.

An even further object of the present invention is to provide a new and improved board game apparatus which is susceptible of a low cost of manufacture with regard to both materials and labor, and which accordingly is then susceptible of low prices of sale to the consuming public, thereby making such board game apparatus economically available to the buying public.

Still yet another object of the present invention is to provide a new and improved board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is an isometric view of a token member mounted on the game board, in a partial view of the game board.

FIG. 10 is an orthographic view, taken on the lines 10—10 of FIG. 9 in the direction indicated by the arrows.

DESCRIPTION OF THE PREFERRED EMBODIMENT

Figure 1:
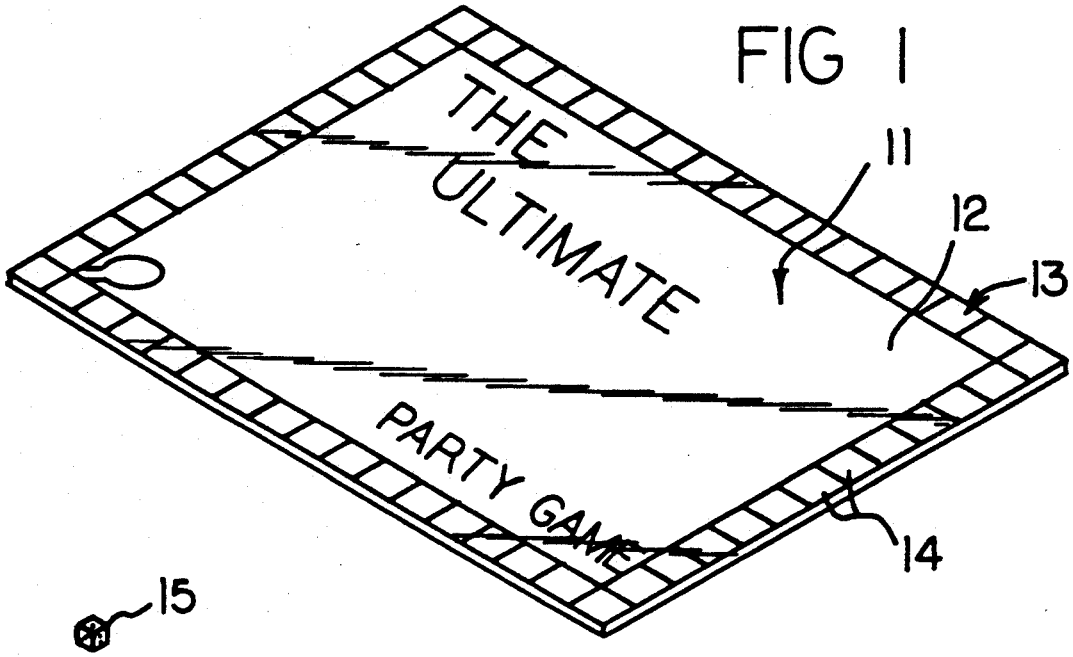
FIG. 1 is an isometric illustration of the game board apparatus of the invention.
Figure 2:
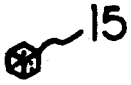
FIG. 2 is an isometric illustration of a die member utilized by the invention.
Figure 3:
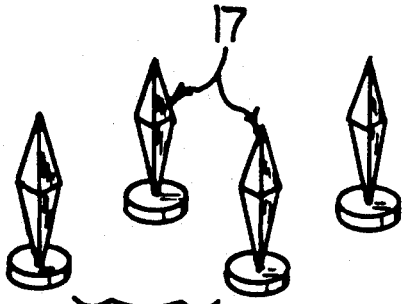
FIG. 3 is an isometric illustration of the token members utilized by the invention.
Figure 5:
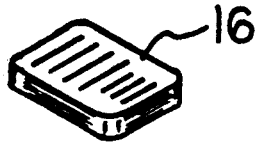
FIG. 5 is an isometric illustration of the card deck utilized by the invention.
Figure 4:
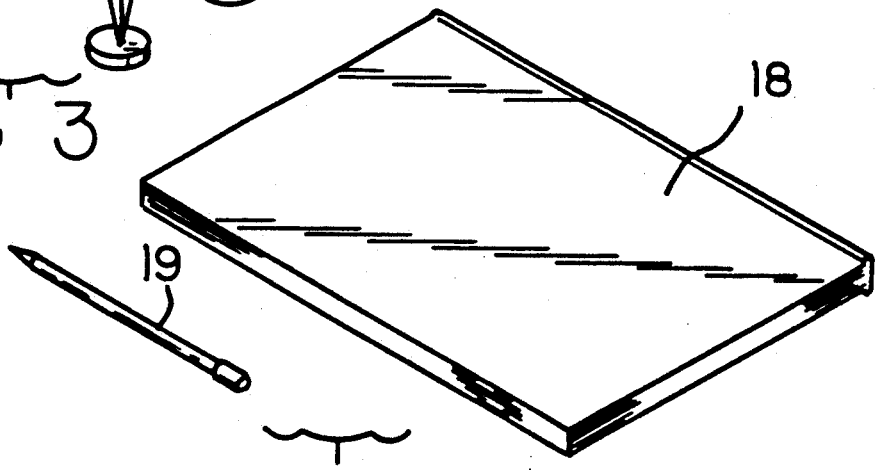
FIG. 4 is an isometric illustration of the writing tablet and instrument utilized by the invention.
Figure 6:
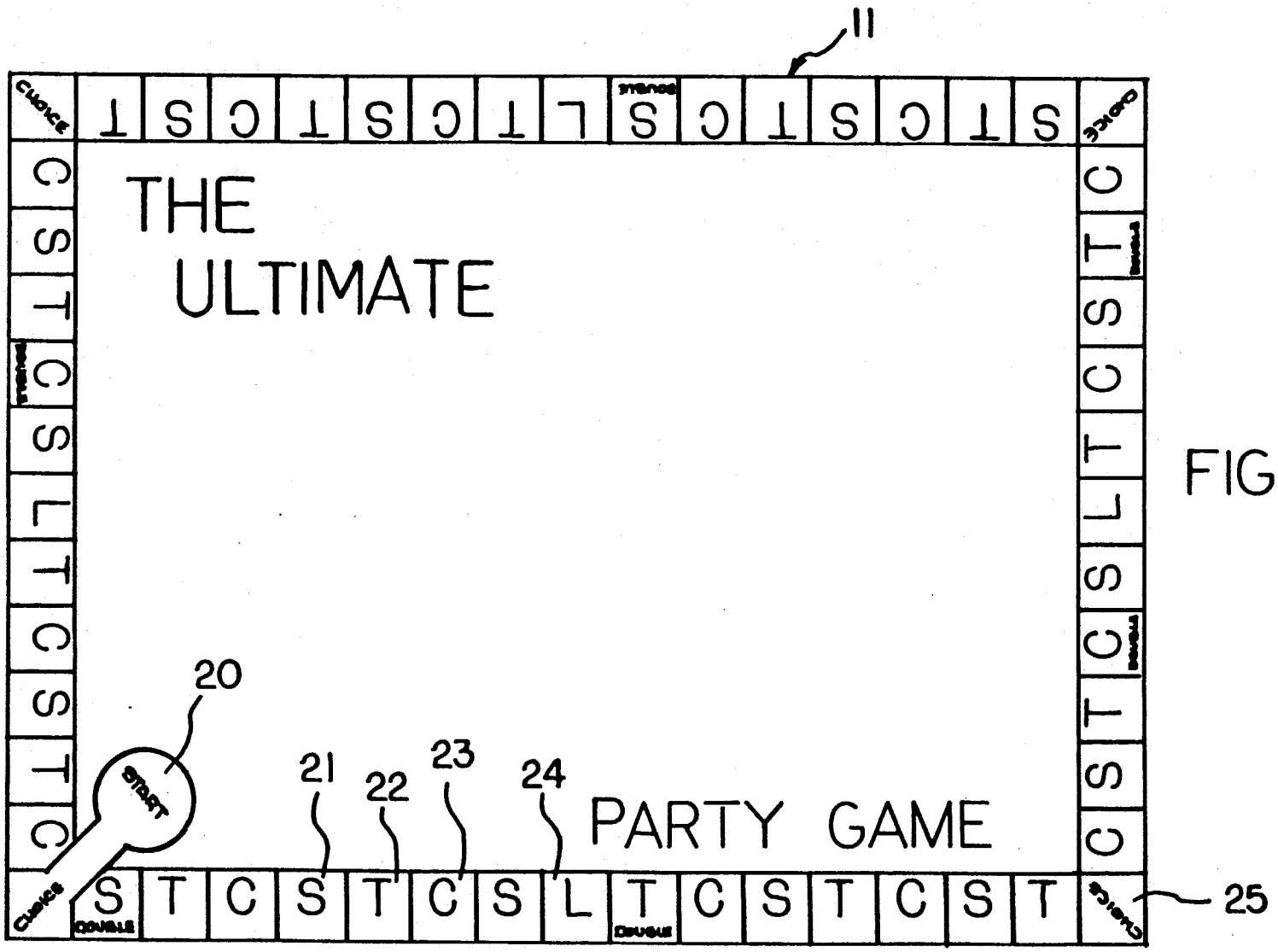
FIG. 6 is an orthographic top view of the game board of the invention.
Figure 7:
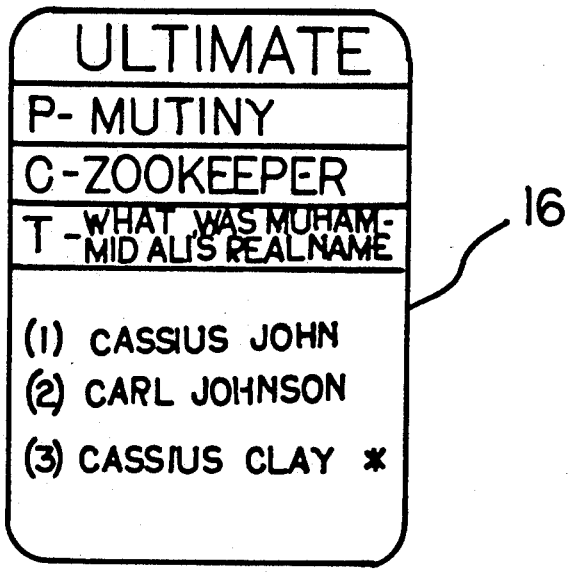
FIG. 7 is an orthographic view of the game board of the invention.

With reference now to the drawings, and in particular to FIGS. 1 to 10 thereof, a new and improved board game apparatus embodying the principles and concepts of the present invention and generally designated by the reference numeral 10 will be described.

More specifically, the board game apparatus 10 of the instant invention essentially comprises a rigid game board 11 having a board top surface 12, with a game path 13 of continuous configuration extending about the top surface 12. The game path 13 is comprised of contiguous game spaces 14, with a die member 15 arranged to direct various game tokens 17 afforded each player in movement about the game path 13 in accordance with indication of the die member 15. Game spaces 14 are arranged to include five categories of spaces, to include a first category space 21 indicated by the letter "S", a second category space 22 indicated by the letter "T", a third category space 23 indicated by the letter "C", and a fourth category space 24 indicated by the letter "L". A plurality of "choice" spaces 25 are provided. The first category of space is directed to the performance of a pantomime, wherein the second category of spaces 22 are directed to the proper response to trivia questions, with the third category of spaces arranged to indicate performance of a charade, and with the fourth category of spaces arranged to direct individuals to effect loss of a turn. The fifth category of spaces are "choice" spaces to permit individuals to choose the categories one through three selectively prior to selecting a directional card 16 from the second directional cards 16. Each directional card includes directions for the carrying out of the first, second, and third category of spaces, whereupon for example should an individual land upon a space with the letter "T" to indicate the second category of spaces, the directional card such as indicated for example on FIG. 7 sets forth that a proper response to the question is to be provided. Upon proper and full completion of a category of the first through third category of spaces, an individual or team is awarded a predetermined number of points, whereupon certain of these spaces utilize the term "double" associated therewith to indicate doubling of the award of points. Attainment of a predetermined total effects a winner to be declared of the players participating in the game. A score tablet 18 is utilized for convenience to maintain point totals, wherein a start space 20 is provided to intersect with the game path 13 to initiate play, and wherein the tokens 17 are initially positioned prior to outset of the game play.

Figure 8:
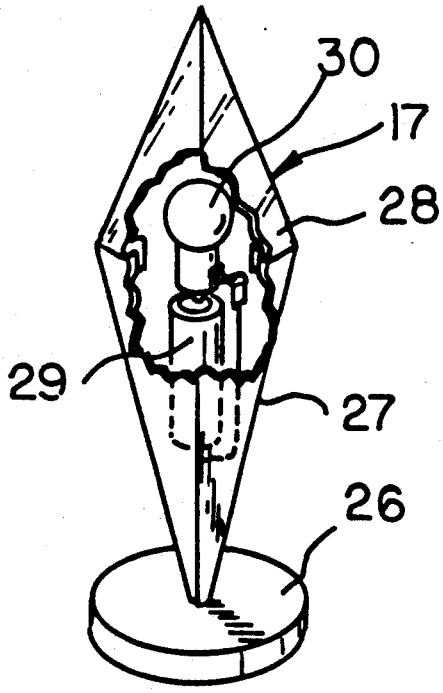
FIG. 8 is an isometric partial sectional view of a token member of the invention.

The FIGS. 8-10 indicate the use of the game tokens 17 for use in limited available light to enhance entertainment and amusement of the game, wherein the tokens are illuminated and light utilized in play of the game is received through the token members 17. Each token 17 includes a base plate 26 mounting an opaque housing 27 thereon, with a transparent dome 28 mounted on the housing. The transparent dome is removably mounted relative to an upper distal end of the housing to permit replacement of various components within the housing 27. A battery 29 is in electrical communication with an illumination bulb 30 to direct illumination through the transparent dome 28 to provide for illumination. The housing 27 includes a mirrored interior surface 31 to reflect illumination through the transparent dome, with the game path 13 having a metallic upper layer 32 about a majority of the spaces 14. Only the fourth category of spaces 24 having a "lose turn" noted by the letter "L" are not availed of the metallic upper layer 32. The metallic upper layer cooperates with the game tokens 17 to effect electrical communication between the illumination bulb 30 and the battery 29. To this end, a first electrical contact 33 and a second electrical contact 34 project below the base plate's bottom surface 35, wherein electrical communication between the first and second electrical contacts 33 and 34 is effected through the metallic upper layer 32 to complete a conventional direct current circuit between the battery 29 and the illumination bulb 30 for illumination of the bulb 30. A first contact spring leg 36 is directed from a first or lowermost end of the battery 29 and directed to the first contact 33, with a second contact spring leg 37 directed from the illumination bulb 30 to the second contact 34. The fourth category of spaces 24 further visually present the individuals having lost a turn upon landing upon such a space, and wherein such individuals are not in need of illumination for reading of a game card or proceeding with play for a subsequent turn.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A board game apparatus, comprising, a rigid game board, the rigid game board including a board top surface having a continuous game path, wherein the game path includes contiguous spaces, wherein the spaces include a plurality of categories to include a first category of spaces, a second category of spaces, a third category of spaces, a fourth category of spaces, and a fifth category of spaces, and game tokens, wherein each player of a plurality of players is awarded a game token, and a die member to direct progression of each game token about the game path, and a plurality of directional cards, wherein each directional card includes a first direction associated with the first category of spaces, a second direction to cooperate with a second category of spaces, a third direction to cooperate with a third category of spaces, and the fourth category of spaces directs a player to lose a turn, and the fifth category of spaces directs a player to choose between the first, second, and third category of spaces, and each token includes a base plate, and the base plate includes an opaque housing mounted on the base plate, and a transparent dome removably mounted upon the opaque housing, a battery mounted within the opaque housing, and an illumination bulb in electrical communication with the battery, with a first electrical contact and a second electrical contact directed below a bottom surface of the base plate in communication with the game path, and wherein the first electrical contact is in communication with the illumination bulb, and wherein only the first, second, third, and fifth category of spaces include an electrical conductive metallic layer to effect electrical communication with the first electrical contact and second electrical contact for illumination of the illumination bulb.

* * * * *